United States Patent [19]

Lundy

[11] 3,943,355

[45] Mar. 9, 1976

[54] LUMINAIRE LATCH AND HINGE

[75] Inventor: Jack W. Lundy, Houston, Tex.

[73] Assignee: Esquire, Inc., New York, N.Y.

[22] Filed: Oct. 17, 1974

[21] Appl. No.: 515,596

[52] U.S. Cl. ..... 240/147; 292/42
[51] Int. Cl.[2] ..... F21V 17/00
[58] Field of Search ..... 240/147, 151, 146; 292/42

[56] References Cited

UNITED STATES PATENTS

| | | | |
|---|---|---|---|
| 1,230,115 | 6/1917 | Clark | 292/42 |
| 2,936,189 | 5/1960 | Pearson | 292/42 |
| 3,380,770 | 4/1968 | Risley | 240/147 |

FOREIGN PATENTS OR APPLICATIONS

| | | | |
|---|---|---|---|
| 966,157 | 3/1950 | France | 292/42 |
| 495,088 | 6/1954 | Italy | 240/147 |

*Primary Examiner*—Joseph F. Peters, Jr.
*Attorney, Agent, or Firm*—Arnold, White & Durkee

[57] ABSTRACT

A spring-loaded, plunger-type unit operating within a recess about a window panel in a luminaire and its housing. Preferable two such units operate within one recess and two other such units operate in an opposite parallel recess so that either pair may be operated as latches while the other pair operate as hinges. Alternatively, all four may operate as latches to permit removal of the panel. The units are substantially flush to conform to the outline of the luminaire, but are easily operable without special tools.

1 Claim, 6 Drawing Figures

FIG. 1
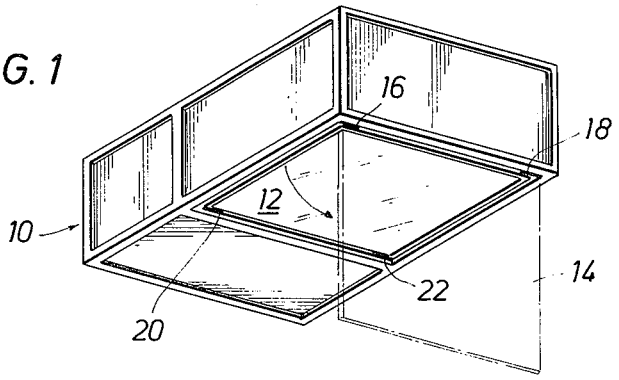
FIG. 2
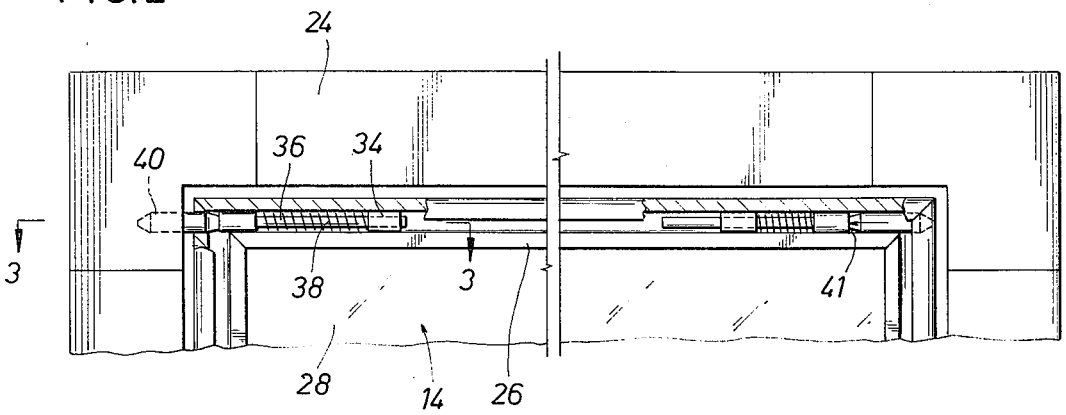
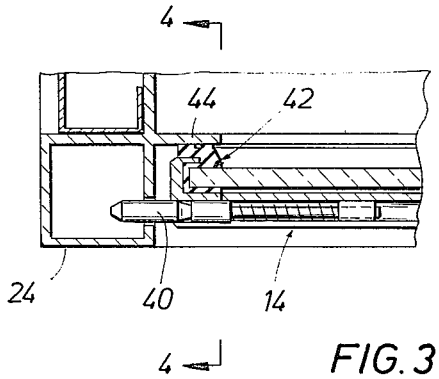
FIG. 3
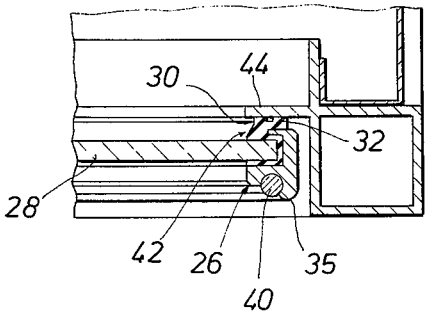
FIG. 4
FIG. 5
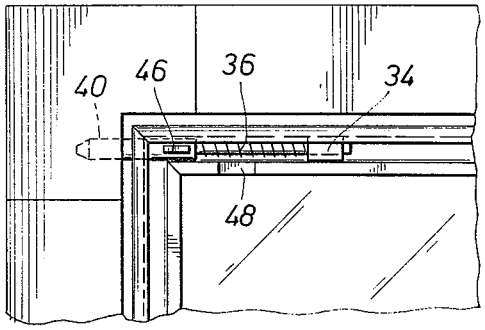
FIG. 6
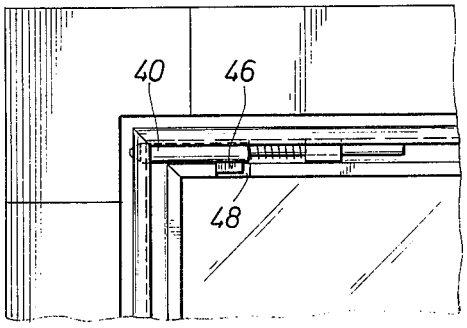

LUMINAIRE LATCH AND HINGE

BACKGROUND OF THE INVENTION

1. Field of the Invention

This invention relates to luminaires and more specifically to latch and hinge mechanisms for fastening a removable panel, preferably the panel including a window, to a luminaire.

2. Description of the Prior Art

Luminaires are required to be both highly functional and artistically pleasing in their surroundings. These two qualities are not always entirely compatible. For example, it is highly desirable for a luminaire to be completely sealed so that the lamp operates in as nearly a dust-free and moisture-free environment as possible. Should the luminaire allow dust to collect therein, the light efficiency will be greatly reduced requiring high maintenance or cleaning cost. Extreme conditions can even cause shorting to occur, thereby reducing the length of life of the lamp or lamps within the fixture and degrading the electrical connections. Moisture accumulation can have the same effects. If dust and moisture-proofing the fixture were the only consideration, luminaires would be permanently sealed and there would be no removable panels.

However, luminaires must be readily and quickly accessible to permit changing of bulbs and for other maintenance purposes. To meet this requirement, the access panel must be equipped with latches that are quickly operable and operable without requiring special tools. One common type of latch that has been used in the past has been the trunk-type latch. This type of latch permits quick access without special tools and permits sealing or compression of a gasket between frame members to minimize dust and moisture entry.

However, a trunk-type latch does not externally conform to the profile of the luminaire and therefore is artistically unacceptable in many installations. Further, flush ceiling mounting of the luminaire, and other similar installation, make trunk latches functionally awkward if not impossible.

Screws have been used to provide both the gasket pressure installation feature and the flush mounting. However, screws do require a special tool, particularly inconvenient in an overhead installation. By using a wingnut and screw or other hand manipulated screw arrangement, the "flush" installation feature is lost. Further, screws and their receiving screw holes do strip out after a number of uses, requiring difficult and expensive maintenance to the overall luminaire.

A further shortcoming of all these prior art latching mechanisms is that they perform only the function of latching and not of hinging. That is, when they are removed or unlatched, the panel is disconnected. This is particularly unhandy in an overhead situation where it is awkward to handle a disconnected panel while at the same time trying to change out a light bulb. Therefore, the prior art mechanisms have required a hinging arrangement in addition to a latching mechanism when complete removal of the panel was to be avoided. When this was done, however, then it made complete removal of the panel, as is sometimes required, a cumbersome and time-consuming undertaking.

It is therefore a feature of this invention to provide a luminaire with an improved latch that conforms with the overall structure and which is easy to unlatch without special tools.

It is another feature of this invention to provide a luminaire with an improved latch that also functions as a hinge to permit removal of a panel secured therewith or alternatively to permit swinging of the panel to provide access to the luminaire for bulb changing and the like.

It is still another feature of this invention to provide an improved latch that is flush with the luminaire when in its closed position, which is operable without special tools and which provides a biasing pressure when secured to allow sealing of a gasket around the panel periphery.

SUMMARY OF THE INVENTION

A preferred embodiment of the invention comprises in a luminaire, four spring-loaded plunger-type rods acting within recesses between the window panel and the frame of the luminaire. These rod latches operate in pairs such that a first pair are on a common axis in one recess while the other pair are on a second common axis in a parallel recess on the opposite side of the panel. The rods are biased outwardly from the corners of the panel and enter respective openings in the frame or housing of the luminaire. The rods are tapered so that they press a lip on the panel forming the bottom of the recess against an oppositely-aligned, gasket-covered edge of the luminaire. An indention or recess on the rods allow a blunt instrument, which may merely be a fingernail, to be inserted to unlatch the rods. If desired two rods on a common axis may be unlatched to permit the panel to swing open, the latched rods acting as hinges. Alternately, the removal of all four rods allows the panel to be completely removed from the luminaire.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrate only typical embodiments of the invention and are therefore not to be considered limiting of its scope, for the invention may admit to other equally effective embodiments.

IN THE DRAWINGS

FIG. 1 is an isometric view of a typical luminaire incorporating a latch and hinge embodiment in accordance with the present invention.

FIG. 2 is a partial plan view of the latch and hinge embodiment incorporated in the luminaire shown in FIG. 1.

FIG. 3 is a cross-sectional view taken at section 3—3 in FIG. 2.

FIG. 4 is a cross-sectional view taken at section 4—4 in FIG. 3.

FIG. 5 is a partial plan view of an alternate latch and hinge embodiment in accordance with the present invention, shown in the closed position.

FIG. 6 is a partial plan view of the embodiment of the present invention shown in FIG. 5, shown in the open and locked back position.

DESCRIPTION OF THE PREFERRED EMBODIMENT

Now referring to the drawings and first to FIG. 1, a luminaire 10 is shown for mounting so that the opening 12 therein allows light to shine from the luminaire in the downward direction. In many installations the luminaire will be substantially flush with the ceiling. As will be described more fully hereinafter, a window panel 14 is secured in the opening so as to hinged at latch and hinges 16 and 18 after latch and hinges 20 and 22 are unlatched. Alternatively, latch and hinges 16 and 18 may be open to permit window panel 14 to be hinged at hinges 20 and 22. Finally, when all latch and hinges 16, 18, 20 and 22 are opened window panel 14 is completely disconnected from luminaire 10.

Now referring to FIG. 2, a preferred embodiment of the hinge and latch arrangement in accordance with the present invention is shown more fully in detail. Frame or housing 24 of the luminaire includes an opening therein which accommodates window panel 14.

Window panel 14 includes a frame member 26 to which the lens 28 is secured. A gasket 30 surrounds the end of lens 28 and is compressed to hold the lens within the frame. It should be noted that frame 26 is L-shaped underneath lens 28 to reside in a receiving groove in gasket 42. To further describe a preferred embodiment of gasket 42, the shape of the gasket on the non-lens side of the L-shaped portion of frame 26 forms two extended nubs 30 and 32.

At the external side of the lens, frame member 26 includes a recess 33 for receiving the rods. As is illustrated, this recess is surrounded by the frame member more than 180° so that the accommodated rods acting therein cannot pull sideways out of the recess. In a preferred embodiment, elongate recessed are described on all four sides of the panel. However, it is within two parallel recesses of this periphery arrangement that the latch and hinge units in accordance with the present invention are mounted.

Again referring to FIG. 2, a stationary or fixed part 34 of the latch and hinge is secured within recess 33 near one corner of the panel. A plunger rod 36 is allowed to act or operate through an opening in fixed part 34, the plunger rod also being slipped through compression spring 38.

Rod 36 is secured to an enlarged and tapered portion 40. Hence, portion 40 is biased away from fixed part 34 along the recess and outwardly at the corner of the panel. A hole in the side of the lens extrusion or frame member 26 that is at right angles to the recess to which the plunger operates, permits plunger 40 to pass through the opening and into an aligned opening within the housing.

It may be seen that two complementary acting latch and hinge units co-axially operate within the same recess, but in opposite directions and at opposing corners of the panel. The left hand plunger in FIG. 2 is shown in the closed position. The right hand plunger is shown in the open position. It should be noted that indentation 41 in plunger 40 permits a blunt instrument to engage the plunger for opposing the compression spring to thereby permit the plunger to be removed from the housing of the luminaire as well as the opening in the adjacent frame member of the panel. Any blunt instrument suitable for overcoming the spring tension is suitable, even a fingernail.

As may be noted by referring to FIGS. 3 and 4, as plunger 40 enters into the opening in the housing, the taper thereon causes panel 14 to bear against gasket 42 on a depressed edge 44 of the housing which is aligned opposite the L-shaped portion of frame 26. This pressure secures the panel so as to minimize dust and moisture leakage. Plunger 26 also may be angled slightly to further ensure this compression force. Note that nubs 30 and 32 are deformed against edge 44 to further complete the desired seal.

FIG. 4 shows a rounding of edge 35 of the panel frame so that when the latch and hinge at the corner shown is used as a hinge, the panel may swing down without binding.

Now referring to FIGS. 5 and 6, an alternate embodiment of the present invention is shown. The only difference between this embodiment and the one previously described is that a raised portion 46 is secured to the large end of plunger 40 and there is no indentation or notch in the larger end. This raised portion may be used in the same manner as the indentation shown in FIG. 2 for opening the latch and hinge unit. The inside of frame member 26, or alternatively the outside of frame member 26, may have an accommodating recess 48 to permit locking of the latch in the open position, as best shown in FIG. 6. The locking is accomplished by merely rotating the plunger 40 until raised portion 46 enters into recess 48. At this time, plunger 40 is cleared of the opening in the housing.

Although the embodiments which are illustrated show a recess 33 which is formed by frame 26 surrounding more than 50% of the recess, please note that the recess may be less than 50%. In such case fixed part 34 may be joined either to frame 26 or to the inside of the housing wall which is now adjacent fixed part 34. In this latter event, the latch is a part of the housing and not a part of the panel, so that when the panel is removed the latch and hinge stays in place. However, there must be ample room to permit rotation and removal of the panel from the housing underneath the plunger arrangement. Also, the latch and hinge units in only one of the two parallel recesses may be connected to the housing to permit panel opening or removal.

In assembly of parts of the embodiment shown in FIG. 4, the rod and related assembly is inserted from the end, or else a corner of frame 26 is milled off to permit insertion. In the embodiment where the surrounding frame covers less than 50% of the recess, not only is fixed part 34 secured, but also it is particularly important to secure the small part of the plunger in such a manner so as to permit movement, but so that it will not fall out.

In operation of the panel on the preferred embodiment (as shown in FIG. 4), it may be seen that opening of all four latch and hinges permits complete removal of panel 14. Alternatively, operating of two latches which are axially aligned in the same recess permits the panel to hingedly open with respect to the pair of hinges operating in the parallel recess. Either set of latches may be operated as hinges in this manner, as desired.

While particular embodiments of the invention have been shown, it will be understood that the invention is not limited thereto since many modifications may be made and will become apparent to those skilled in the art.

What is claimed is:

1. A luminaire adapted to be supported above an area to be lighted and having a hinged access panel that is capable of being removed and is also capable of pivotal movement to an open position allowing personnel to gain access to the interior of the housing, comprising a housing having an opening on one side thereof for receiving a pivotally movable and removable panel, a movable and removable panel having an elongate recess defined on at least one side thereof, at least one spring-loaded latch and pivot element positioned within said recess, said latch and pivot element having a fixed part thereof being secured to said panel adjacent said recess, said latch also having a movable part thereof being urged to project from an end of said recess, said housing being formed to define a hole for receiving the movable part of said latch and pivot element, said latch and pivot element being substantially flush with said panel and accessible for operating as an external latch for securing said panel to said housing, being movable to an unlatching position to render said panel removable and when in engagement with said hole, serving as a pivot to retain said panel in pivotal relation with said housing, said panel to which said fixed part of said latch and pivot element is secured including a depression, said movable part of said latch and pivot element including a projection to fit into said depression when said movable part is moved in opposition to its biasing clear of said hole in said housing and rotated, and said movable part of said latch and pivot element being both linearly movable and rotatable to accomplish locking within said hole and latching within said depression.

* * * * *